US009257131B2

(12) United States Patent
Watanabe

(10) Patent No.: US 9,257,131 B2
(45) Date of Patent: Feb. 9, 2016

(54) SPEECH SIGNAL PROCESSING APPARATUS AND METHOD

(71) Applicant: FUJITSU LIMITED, Kawasaki-shi, Kanagawa (JP)

(72) Inventor: Kazuhiro Watanabe, Setagaya (JP)

(73) Assignee: FUJITSU LIMITED, Kawasaki (JP)

( * ) Notice: Subject to any disclaimer, the term of this patent is extended or adjusted under 35 U.S.C. 154(b) by 175 days.

(21) Appl. No.: 14/067,446

(22) Filed: Oct. 30, 2013

(65) Prior Publication Data

US 2014/0136191 A1 May 15, 2014

(30) Foreign Application Priority Data

Nov. 15, 2012 (JP) ..... 2012-251260

(51) Int. Cl.
*G10L 19/00* (2013.01)
*G10L 21/00* (2013.01)
*G10L 21/013* (2013.01)

(52) U.S. Cl.
CPC ..... *G10L 21/013* (2013.01)

(58) Field of Classification Search
USPC ..... 704/217, 218, 207, E19.036, E11.006
See application file for complete search history.

(56) References Cited

U.S. PATENT DOCUMENTS 5,267,317 A * 11/1993 Kleijn ..... 704/217
5,452,398 A 9/1995 Yamada et al.
5,671,330 A 9/1997 Sakamoto et al.
6,226,606 B1 * 5/2001 Acero et al. ..... 704/218
7,630,883 B2 * 12/2009 Sato ..... 704/207
8,271,284 B2 * 9/2012 Kato ..... 704/260
2009/0177475 A1 * 7/2009 Kato ..... 704/260
2011/0320199 A1 * 12/2011 Luan et al. ..... 704/235

FOREIGN PATENT DOCUMENTS

JP 5-307399 11/1993
JP 8-95589 4/1996
JP 8-202395 8/1996

OTHER PUBLICATIONS

Patent Abstracts of Japan, Publication No. 08-095589, Published Dec. 4, 1996.
Patent Abstracts of Japan, Publication No. 05-307399, Published Nov. 19, 1993.
Patent Abstracts of Japan. Publication No. 08-202395, Published Aug. 9, 1996.

* cited by examiner

*Primary Examiner* — Edgar Guerra-Erazo
(74) *Attorney, Agent, or Firm* — Staas & Halsey LLP

(57) ABSTRACT

A speech signal processing apparatus includes an amplitude and phase signal generation section that, based on an analyzing signal expressed by a complex signal generated from a speech signal applied with pitch marks every 1 pitch cycle, generates an amplitude signal and a phase signal on the time axis of the speech signal, a phase signal conversion section that converts the phase signal into a phase signal of a target pitch cycle width for each section of the 1 pitch cycle width based on the pitch marks, and a pitch conversion speech signal generation section that generates a speech signal in which pitch cycle is converted to the target pitch cycle based on an amplitude signal of the target pitch cycle width of a section corresponding to the section of the amplitude signal and based on a phase signal of the target pitch cycle width.

12 Claims, 13 Drawing Sheets

SPEECH SIGNAL PROCESSING APPARATUS AND METHOD

CROSS-REFERENCE TO RELATED APPLICATION

This application is based upon and claims the benefit of priority of the prior Japanese Patent Application No. 2012-251260, filed on Nov. 15, 2012, the entire contents of which are incorporated herein by reference.

FIELD

The embodiments discussed herein are related to a speech signal processing apparatus, a speech signal processing method and a recording medium recorded with a speech signal processing program.

BACKGROUND

In order to change the pitch of a speech, conventionally a pitch cycle of a speech signal that is a cyclical waveform is converted to a specific pitch cycle. Pitch Synchronous Overlap and Add (PSOLA) is a known method employed as pitch conversion processing to convert the pitch cycle of a speech signal, and PSOLA is widely implemented in the field of speech synthesis. In a PSOLA method, a pitch cycle is converted by cutting out speech signals at every pitch cycle of the speech signal using a window function with a length that is about twice a specific pitch cycle, rearranging the cut out speech signal at intervals of the specific pitch cycle, and weighting and overlapping the segments.

However, when a high pitched voice is synthesized using a PSOLA method, for example when a pitch cycle T of an original speech signal is converted to T/2 (0.5 times the pitch cycle), such as illustrated on the top row of FIG. 17, sometimes the amplitude of the speech signal is reduced after pitch cycle conversion, such as illustrated on the bottom row of FIG. 17. Moreover, in a case in which the phase signal of the original speech signal changes linearly, as illustrated on the top row of FIG. 18, an example of the phase signal of the speech signal after conversion is illustrated on the bottom row of FIG. 18 for when a pitch cycle T of an original speech signal is converted to T/2 (0.5 times the pitch cycle) using a PSOLA method. In such examples, non-continuous locations (phase signal jumps) occur in the phase signal in the vicinity of a central portion in each 1 pitch cycle of a phase signal of a speech signal that changes linearly.

Accordingly, in cases in which a PSOLA method is employed to convert a pitch cycle to a narrower pitch cycle (for example 1/1.5 or less), there is an issue that sometimes a deterioration in sound quality of the speech signal occurs after pitch cycle conversion due to a reduction in amplitude and jumps in phase As a method to suppress deterioration in sound quality by a PSOLA method, a method is proposed in which pitch markers are appropriately determined to define the positions to cut out the speech signal, apply weighting and overlap when pitch cycle conversion processing is performed using a PSOLA method.

There is also a proposal for a speech analysis method in which amplitude data and phase data of an analyzing speech signal are derived, and a pulse train that is to be the sound source data is set on the time axis of the speech signal so as to correspond to the pitch cycle of the analyzing speech signal. In such a speech analysis method, the difference between phase data of the set pulse train and the phase data of the speech signal is employed as a 1 desired pitch cycle's worth of phase data in the analyzing speech signal.

RELATED PATENT DOCUMENTS

Japanese Application Laid-Open Patent Publication No. H08-95589

Japanese Application Laid-Open Patent Publication No. H08-202395

Japanese Application Laid-Open Patent Publication No. H05-307399

SUMMARY

According to an aspect of the embodiments, an apparatus includes: an amplitude and phase signal generation section that, based on an analyzing signal expressed by a complex signal generated from a speech signal to which pitch marks are applied every 1 pitch cycle, generates an amplitude signal and a phase signal on a time axis of the speech signal; a phase signal conversion section that converts the phase signal generated by the amplitude and phase signal generation section into a phase signal of a target pitch cycle width for each section of a 1 pitch cycle width based on the pitch marks; and a pitch conversion speech signal generation section that generates a speech signal in which a pitch cycle is converted to the target pitch cycle based on an amplitude signal of the target pitch cycle width of a section corresponding to the section of the amplitude signal generated by the amplitude and phase signal generation section and based on a phase signal of the target pitch cycle width converted by the phase signal conversion section.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Detailed explanation follows regarding an example of an exemplary embodiment of technology disclosed herein, with reference to the drawings.

First Exemplary Embodiment

Figure 1:
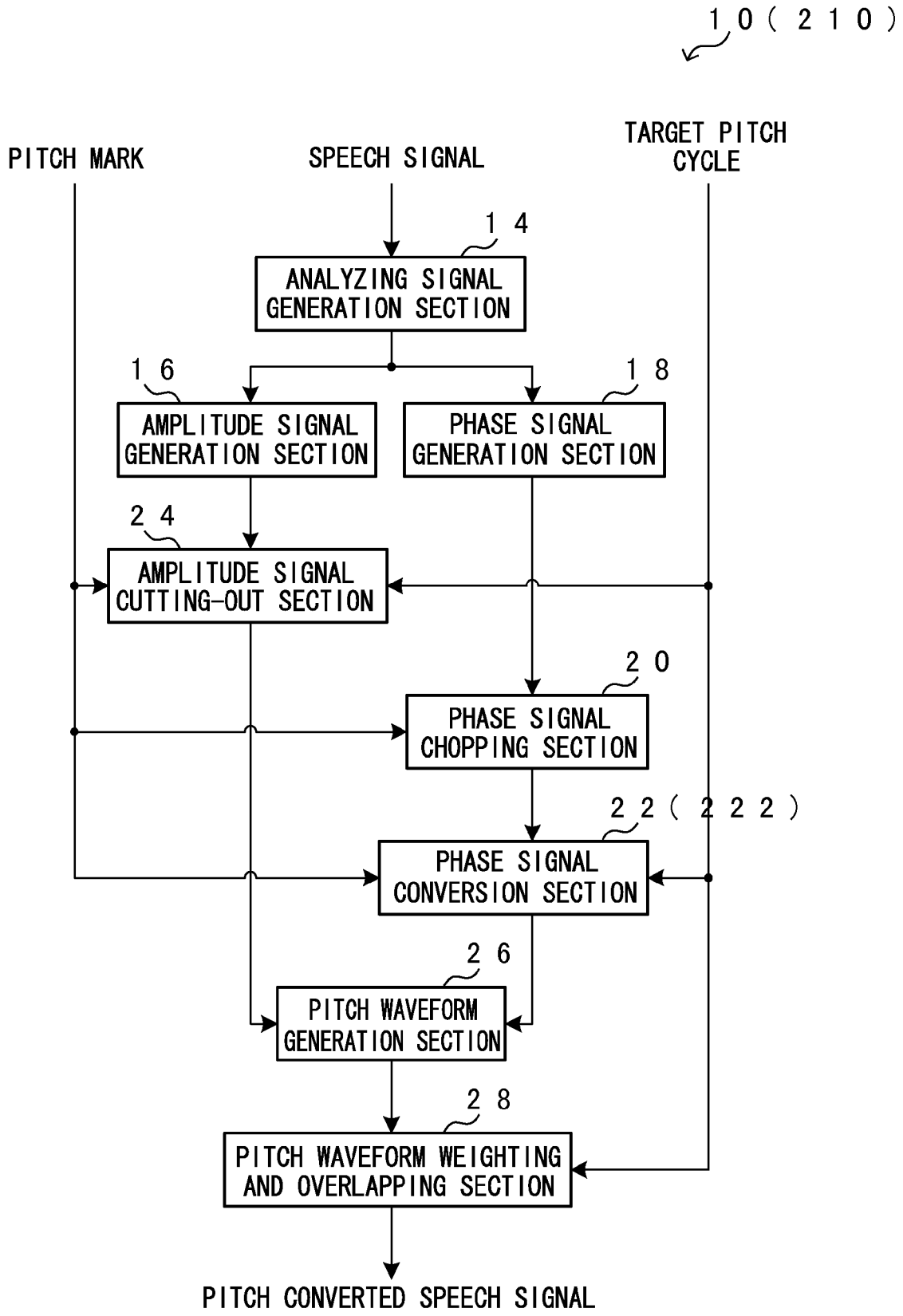
FIG. 1 is a functional block diagram illustrating an example of a speech signal processing apparatus according to a first exemplary embodiment and a second exemplary embodiment.

FIG. 1 illustrates a speech signal processing apparatus 10 according to a first exemplary embodiment. The speech signal processing apparatus 10 includes an analyzing signal generation section 14, an amplitude signal generation section 16, a phase signal generation section 18, a phase signal chopping section 20, a phase signal conversion section 22, an amplitude signal cutting-out section 24, a pitch waveform generation section 26 and a pitch waveform weighting and overlapping section 28. Note that the analyzing signal generation section 14, the amplitude signal generation section 16 and the phase signal generation section 18 are an example of the amplitude and phase signal generation section of technology disclosed herein. The phase signal chopping section 20 and the phase signal conversion section 22 are an example of the phase signal conversion section of technology disclosed herein. The amplitude signal cutting-out section 24, the pitch waveform generation section 26 and the pitch waveform weighting and overlapping section 28 are an example of the pitch conversion speech signal generation section of the technology disclosed herein.

The speech signal processing apparatus 10 receives a speech signal that is a real signal, pitch marks, and a target pitch cycle T1 that is the pitch cycle after conversion. The pitch marks are, as illustrated in (A) of FIG. 2, applied at the start or the end position (t) of each 1 pitch cycle of the speech signal. Namely, a segment sandwiched between pitch marks has a 1 pitch cycle T0.

The analyzing signal generation section 14 generates an analyzing signal that is a complex signal on the time axis from a speech signal that is an input real signal. The method employed to generate the analyzing signal from the speech signal may be, for example, a method that uses a Hilbert transform. More specifically, Fast Fourier Transformation (FFT) is applied to the speech signal that is the input real signal. Then an analyzing signal that is a complex signal on the time axis can be obtained by applying inverse FTT to frequency vectors resulting from removing negative frequency components of the frequency vectors obtained by FFT.

As illustrated by the following Equation (1), the analyzing signal S(t) is expressed in terms of a real part signal I (t) and an orthogonal imaginary part signal Q (t).

$$S(t)=I(t)+jQ(t) \tag{1}$$

Figure 2:
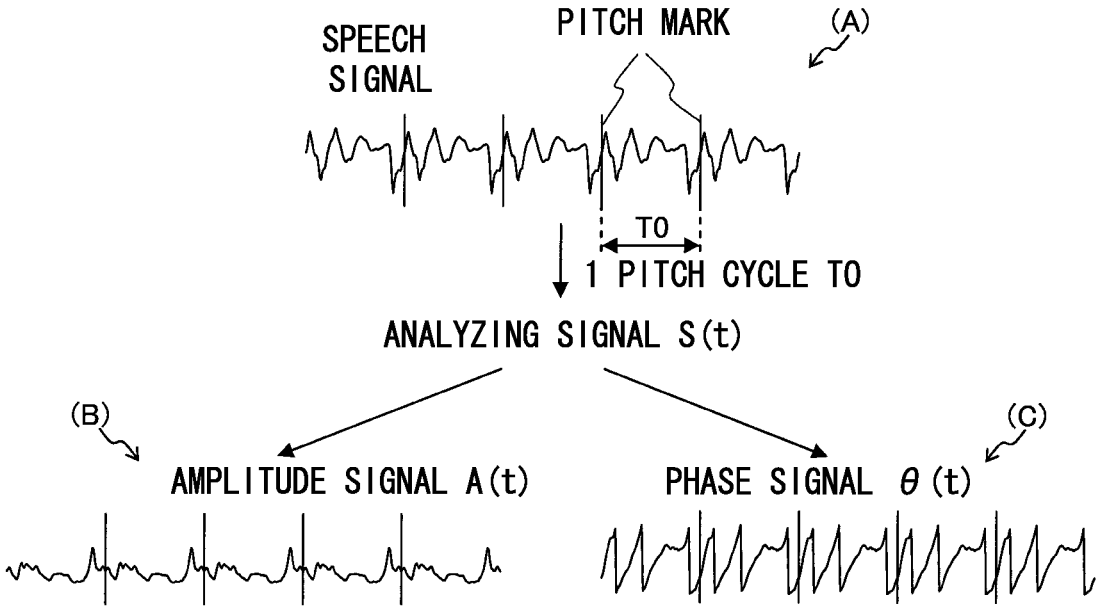
FIG. 2 is a schematic diagram to explain processing in an amplitude signal generation section and a phase signal generation section.

The amplitude signal generation section 16, as illustrated in (B) of FIG. 2, employs the real part signal I (t) and the imaginary part signal Q (t) configuring the analyzing signal generated by the analyzing signal generation section 14 to generate an amplitude signal A(t) on the time axis of the speech signal according to following Equation (2).

$$A(t)=\sqrt{I(t)^2+Q(t)^2} \tag{2}$$

The phase signal generation section 18, as illustrated in (C) of FIG. 2, employs the real part signal I (t) and the imaginary part signal Q (t) configuring the analyzing signal generated by the analyzing signal generation section 14 to generate a phase signal θ(t) on the time axis of the speech signal according to following Equation (3).

$$\theta(t) = \tan^{-1}\left(\frac{Q(t)}{I(t)}\right) \tag{3}$$

Figure 3:
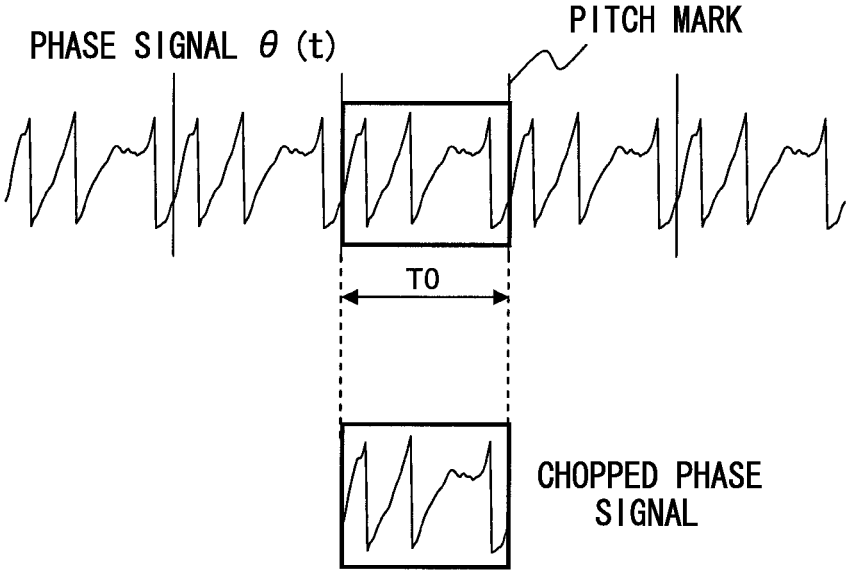
FIG. 3 is a schematic diagram to explain processing of a phase signal chopping section.

The phase signal chopping section 20, as illustrated in FIG. 3, references the pitch marks applied to the speech signal to chop segments of 1 pitch cycle T0 width sandwiched between pitch marks from the phase signal θ(t) generated by the phase signal generation section 18. The phase signal chopping section 20 outputs the phase signal that has been chopped as a chopped phase signal to the phase signal conversion section 22.

Figure 4:
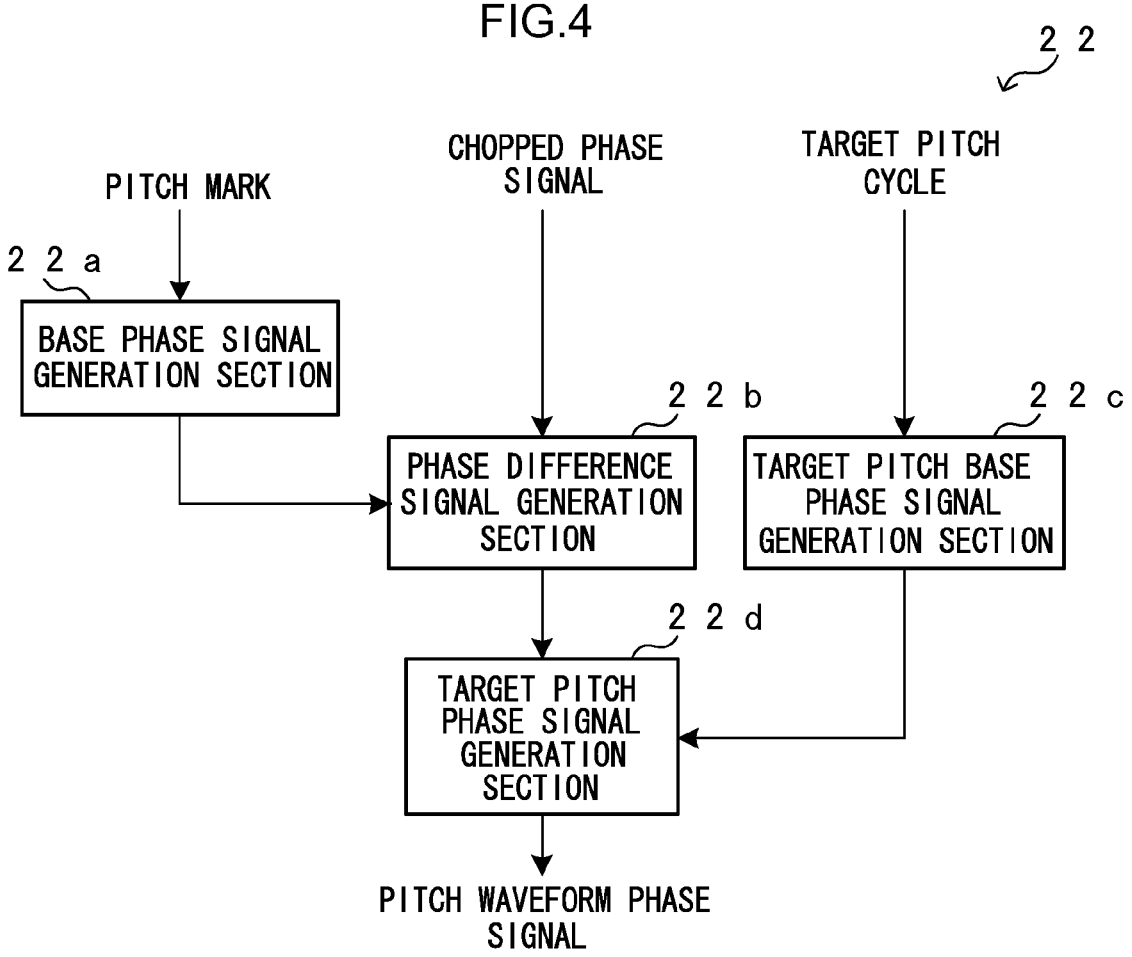
FIG. 4 is a functional block diagram illustrating an example of a phase signal conversion section.

The phase signal conversion section 22 converts the chopped phase signal that was chopped by the phase signal chopping section 20 into a pitch waveform phase signal that reflects the characteristics of the target pitch cycle speech signal. The phase signal conversion section 22, as illustrated in FIG. 4, includes a base phase signal generation section 22*a*, a phase difference signal generation section 22*b*, a target pitch base phase signal generation section 22*c* and a target pitch phase signal generation section 22*d*.

According to a conventional PSOLA method, when overlap processing is performed so as to simply rearrange a chopped speech signal at the target pitch cycle interval, characteristics of the phase signal contained in the original speech signal influence the characteristics of the phase signal contained in the speech signal after pitch conversion. More specifically, influence is received from traces of the shape of the phase signal at the head portion and tail portion in the pitch cycle of the original speech signal, with a jump in phase occurring in the vicinity of a central portion in each 1 pitch cycle of a phase signal contained in the speech signal after pitch conversion due to the overlap processing during pitch conversion. Jumps in phase such as these are a cause of deterioration in the speech signal. Note that the vicinity of a central portion of each 1 pitch cycle means a region where the tail portion in the pitch cycle and the head portion in the next pitch cycle of the original speech signal overlap with each other.

Moreover, when the original speech signal is simply segmented, 1 pitch cycle of the phase signal contained in the speech signal after pitch conversion is one in which the phase signal is not continuous from the start point to the end point of 1 pitch cycle in the original speech signal. When overlap processing is performed on a speech signal with 1 pitch cycle's worth of phase signal that is not continuous there is sometimes a drop in the amplitude of the speech signal after pitch conversion from such factors as signals canceling each other out.

Thus in the phase signal conversion section 22, the phase signal on the time axis is converted into a phase signal reflecting the characteristics of the target pitch cycle speech signal while making a continuous phase signal from the start point to the end point of 1 pitch cycle in the original speech signal. In the present exemplary embodiment, in components of the phase signal, the base phase signal, corresponding to the fundamental frequency that particularly dominates the characteristics of a speech signal is manipulated. This accordingly enables audio quality deterioration due to jumps in phase and amplitude reduction that occur in conventional PSOLA to be suppressed.

Detailed explanation follows regarding the above point, with respect to each subsection in the phase signal conversion section 22.

Figure 5:
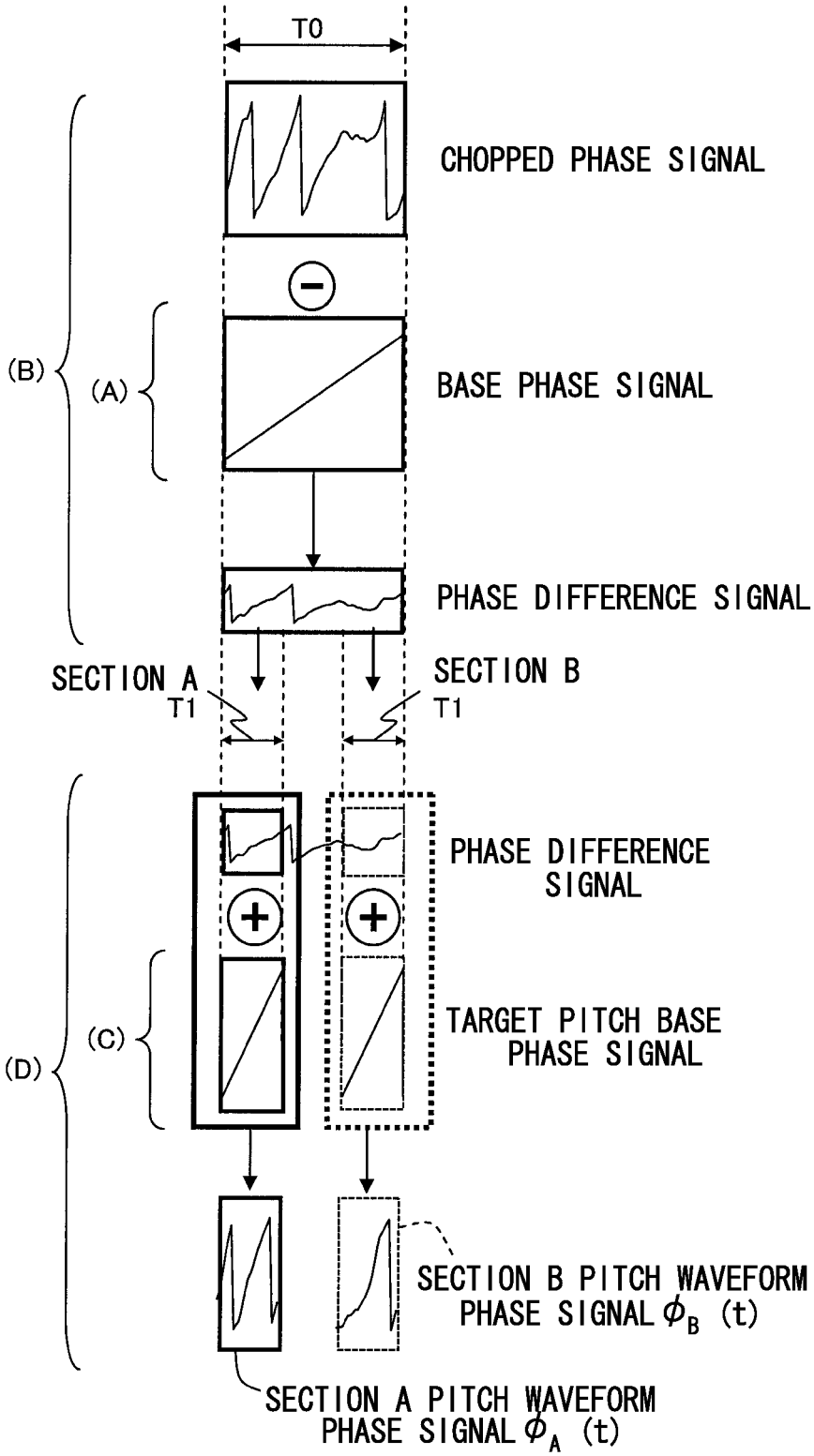
FIG. 5 is a schematic diagram to explain processing in a phase signal conversion section of a first exemplary embodiment.

The base phase signal generation section 22*a*, references the pitch marks applied to the speech signal and generates, as illustrated in (A) of FIG. 5, a base phase signal with a phase that increases monotonically from the start point towards the end point of the pitch cycle T0 so as to give a phase difference of $2\pi$ between the end point and the start point. For example, a base phase signal may be generated that increases linearly with a phase at the start point of the pitch cycle of $-\pi$, a phase at the midpoint of 0, and a phase at the end point of $+\pi$. Alternatively, a base phase signal may be generated that increases linearly with a phase at the start point of pitch cycle of 0, a phase at the midpoint of $\pi$, and a phase at the end point of $+2\pi$.

The phase difference signal generation section 22*b*, as illustrated in (B) of FIG. 5, generates a phase difference signal by subtracting the base phase signal generated by the base phase signal generation section 22*a* from the chopped phase signal of pitch cycle T0 width chopped by the phase signal chopping section 20.

The target pitch base phase signal generation section 22*c*, with reference to the target pitch cycle T1, as illustrated in (C) of FIG. 5, generates a target pitch base phase signal so as to monotonically increase from the start point towards the end point of the target pitch cycle T1 with a phase difference between the end point and the start point that is $2\pi$. For example, a target pitch base phase signal may be generated with a phase at the start point of the target pitch cycle of $-\pi$, a phase at the midpoint of 0, and a phase at the end point of $+\pi$ with a linear increase in phase. Alternatively, a target pitch base phase signal may be generated with a phase at the start point of the target pitch cycle of 0, a phase at the midpoint of $\pi$, and a phase at the end point of $+2\pi$ with a linear increase in phase Moreover, the target pitch base phase signal generation section 22*c*, as illustrated in (C) of FIG. 5, generates a target pitch base phase signal corresponding to a section A and a section B of the target pitch cycle T1 respectively at the head portion and the tail portion of the phase difference signal generated by the phase difference signal generation section 22*b*.

The target pitch phase signal generation section 22*d*, as illustrated in (D) of FIG. 5, overlaps the signal of section A of the phase difference signal generated by the phase difference signal generation section 22*b* with the target pitch base phase signal corresponding to section A generated by the target pitch base phase signal generation section 22*c*. Moreover, in a similar manner, the target pitch phase signal generation section 22*d* also overlaps the signal of section B of the phase difference signal generated by the phase difference signal generation section 22*b* with the target pitch base phase signal corresponding to section B generated by the target pitch base phase signal generation section 22*c*. The signals of the phase difference signal overlapped with the target pitch base phase signal for both the section A and the section B are output respectively as a pitch waveform phase signal $\phi_A(t)$ of section A, and a pitch waveform phase signal $\phi_B(t)$ of section B.

The phase signal conversion section 22 accordingly converts the phase signal to correspond to the target pitch cycle while still maintaining the shape of the base phase signal that dominates the characteristics of the speech signal (characteristics from the start point to the end point of the pitch cycle). Converting the phase signal as the phase signal in a continuous state from the start point to the end point of each 1 pitch cycle accordingly enables suppression of a decrease in amplitude of the speech signal and jumps in the phase signal after pitch conversion.

Figure 6:
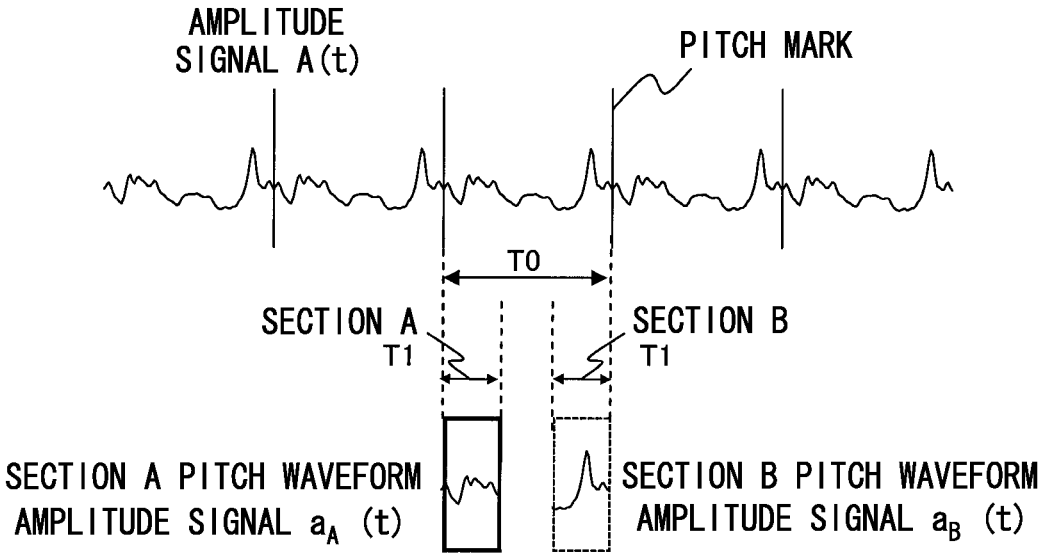
FIG. 6 is a schematic diagram to explain processing in an amplitude signal cutting-out section.

The amplitude signal cutting-out section 24 references the pitch marks applied to the speech signal and the target pitch cycle T1 and cuts out a pitch waveform amplitude signal a(t) of the target pitch cycle T1 from the amplitude signal A(t) generated by the amplitude signal generation section 16. As illustrated in FIG. 6, in the amplitude signal A(t) generated by the amplitude signal generation section 16, signals of the section A and the section B of the target pitch cycle T1 are cut out respectively at the head portion and tail portion of a segment of 1 pitch cycle width sandwiched between pitch marks. Segments of 1 pitch cycle T0 width are segments corresponding to the segments that where chopped by the phase signal chopping section 20 from the chopped phase signal. Consequently, the section A and the section B signals that are cut out by the amplitude signal cutting-out section 24 correspond to the section A and the section B pitch waveform phase signals generated by the phase signal conversion section 22. The amplitude signal cutting-out section 24 outputs to the pitch waveform generation section 26 a signal cut out from the section A as a pitch waveform amplitude signal $a_A(t)$ and a signal cut out from the section B as a pitch waveform amplitude signal $a_B(t)$.

Figure 7:
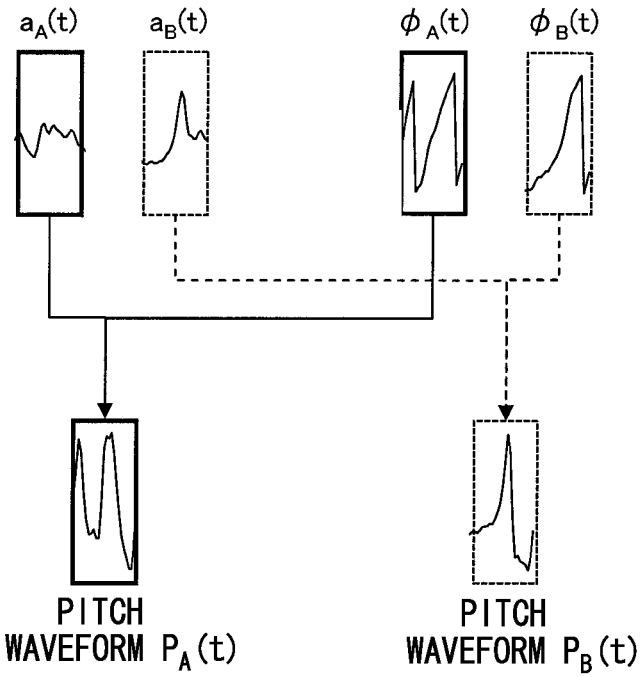
FIG. 7 is a schematic diagram to explain processing in a pitch waveform generation section.

The pitch waveform generation section 26, as illustrated in FIG. 7, generates a pitch waveform $P_A(t)$ from the pitch waveform amplitude signal $a_A(t)$ of the section A cut out by the amplitude signal cutting-out section 24 and the pitch waveform phase signal $\phi_A(t)$ of the section A generated by the target pitch phase signal generation section 22*d*. Similarly, the pitch waveform generation section 26 generates a pitch waveform $P_B(t)$ from the pitch waveform amplitude signal $a_B(t)$ of the section B cut out by the amplitude signal cutting-out section 24 and the pitch waveform phase signal $\phi_B(t)$ of the section B generated by the target pitch phase signal generation section 22*d*.

More specifically, the pitch waveform generation section 26 generates a pitch waveform P(t) according to the following Equation (4) from the pitch waveform amplitude signal a(t) and the pitch waveform phase signal $\phi(t)$.

$$P(t)=a(t)\cdot\cos\phi(t) \tag{4}$$

Figure 8:
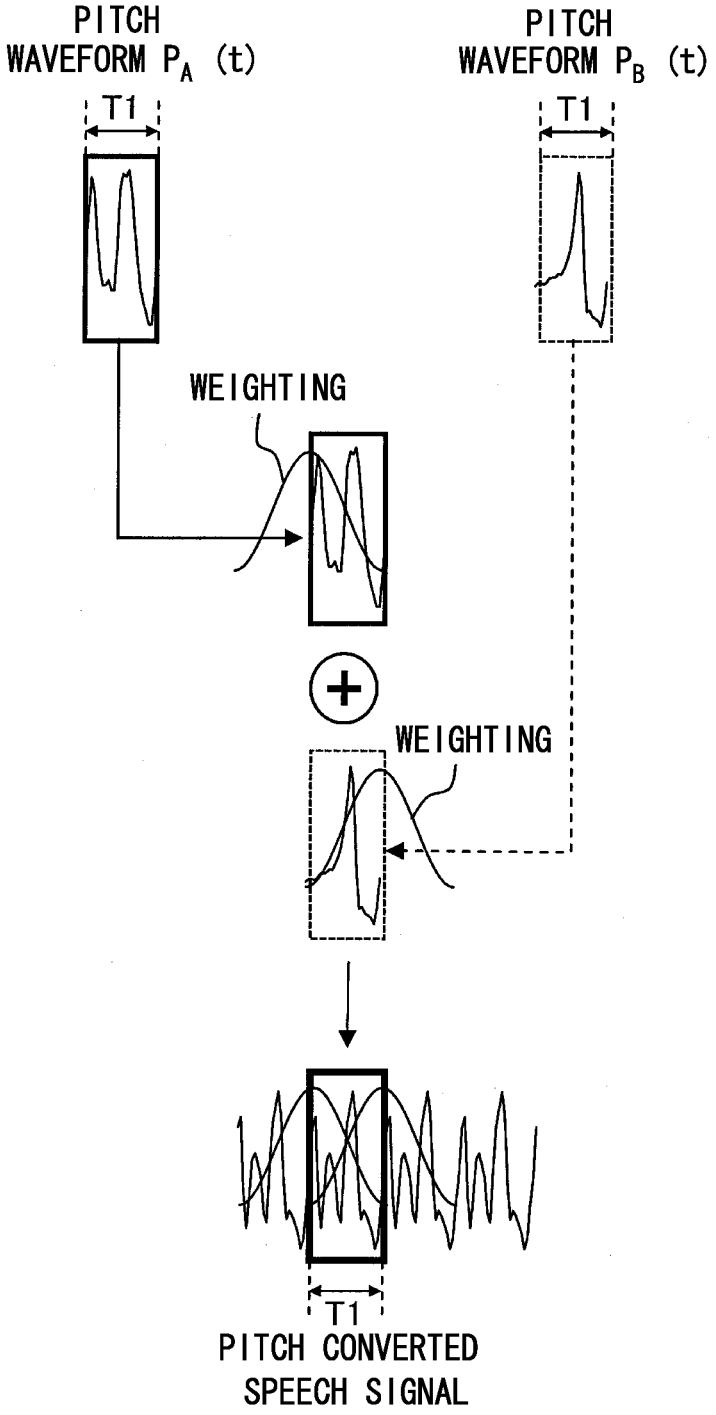
FIG. 8 is a schematic diagram to explain processing in a pitch waveform weighting and overlapping section.

The pitch waveform weighting and overlapping section 28, as illustrated in FIG. 8, weights the pitch waveform $P_A(t)$ of section A by employing a window function with magnitude that gradually decreases, and weights the pitch waveform $P_B(t)$ of section B by employing a window function with magnitude that gradually increases. The window function may, for example, be a Hanning window function. In such cases, the right hand half of the Hanning window function is applied to the section A, and the left hand half of the Hanning window function is applied to the section B. The two sections of weighted pitch waveforms are then added together. A pitch converted speech signal is accordingly generated such that the pitch cycle becomes the target pitch cycle T1.

Figure 9:
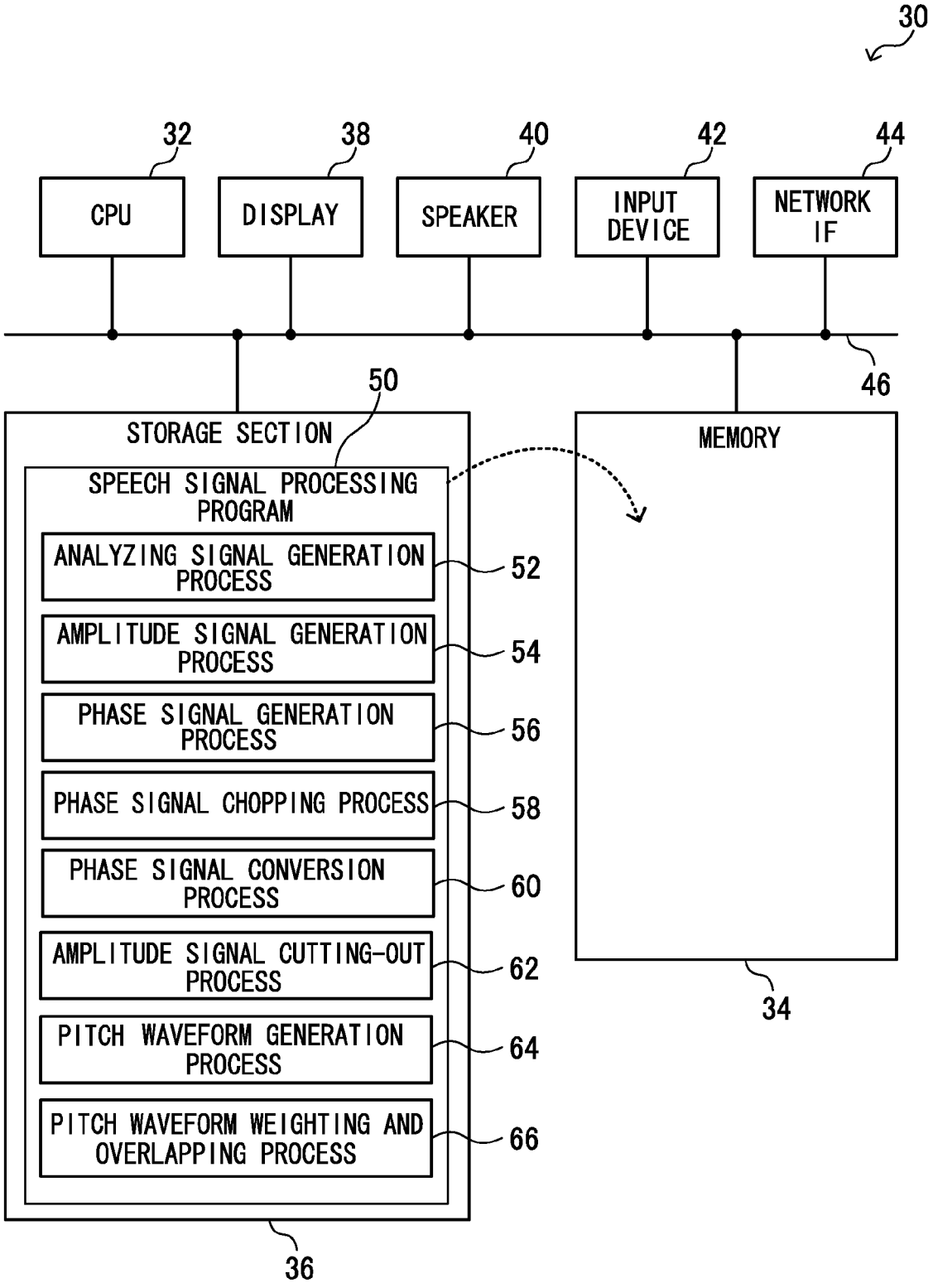
FIG. 9 is a schematic block diagram illustrating an example of a computer that functions as a speech signal processing apparatus.

The speech signal processing apparatus 10 may, for example, be implemented by a computer 30 as illustrated in FIG. 9. The computer 30 includes a CPU 32, a memory 34, a non-volatile storage section 36, a display 38, a speaker 40, an input device 42 such as a mouse and a keyboard, and a network interface (IF) 44. The CPU 32, the memory 34, the storage section 36, the display 38, the speaker 40, the input device 42 and the network IF 44 are connected together through a bus 46.

The storage section 36 may be implemented for example by a Hard Disk Drive (HDD) or a flash memory. The storage section 36, serving as a recording medium, stores a speech signal processing program 50 to make the computer 30 function as the speech signal processing apparatus 10. The CPU 32 reads the speech signal processing program 50 from the storage section 36, expands the speech signal processing program 50 in the memory 34 and sequentially executes the processes of the speech signal processing program 50.

The speech signal processing program 50 includes an analyzing signal generation process 52, an amplitude signal generation process 54, and a phase signal generation process 56. The speech signal processing program 50 also includes a phase signal chopping process 58 and a phase signal conversion process 60. The speech signal processing program 50 also includes an amplitude signal cutting-out process 62, a pitch waveform generation process 64 and a pitch waveform weighting and overlapping process 66.

The CPU 32 operates as the analyzing signal generation section 14 illustrated in FIG. 1 by executing the analyzing signal generation process 52. The CPU 32 operates as the amplitude signal generation section 16 illustrated in FIG. 1 by executing the amplitude signal generation process 54. The CPU 32 operates as the phase signal generation section 18 illustrated in FIG. 1 by executing the phase signal generation process 56. The CPU 32 operates as the phase signal chopping section 20 illustrated in FIG. 1 by executing the phase signal chopping process 58. The CPU 32 operates as the phase signal conversion section 22 illustrated in FIG. 1 by executing the phase signal conversion process 60. The CPU 32 operates as the amplitude signal cutting-out section 24 illustrated in FIG. 1 by executing the amplitude signal cutting-out process 62. The CPU 32 operates as the pitch waveform generation section 26 illustrated in FIG. 1 by executing the pitch waveform generation process 64. The CPU 32 operates as the pitch waveform weighting and overlapping section 28 illustrated in FIG. 1 by executing the pitch waveform weighting and overlapping process 66. The computer 30 executing the speech signal processing program 50 accordingly functions as the speech signal processing apparatus 10.

Note that it is possible to implement the speech signal processing apparatus 10 with for example a semiconductor integrated circuit, and more particularly such as by an Application Specific Integrated Circuit (ASIC).

Explanation follows regarding operation of the first exemplary embodiment. On input of a speech signal that has been applied with pitch marks, and a target pitch cycle T1, the speech signal processing apparatus 10 expands the speech signal processing program 50 stored in the storage section 36 into the memory 34, and executes the speech signal processing illustrated in FIG. 10.

Figure 10:
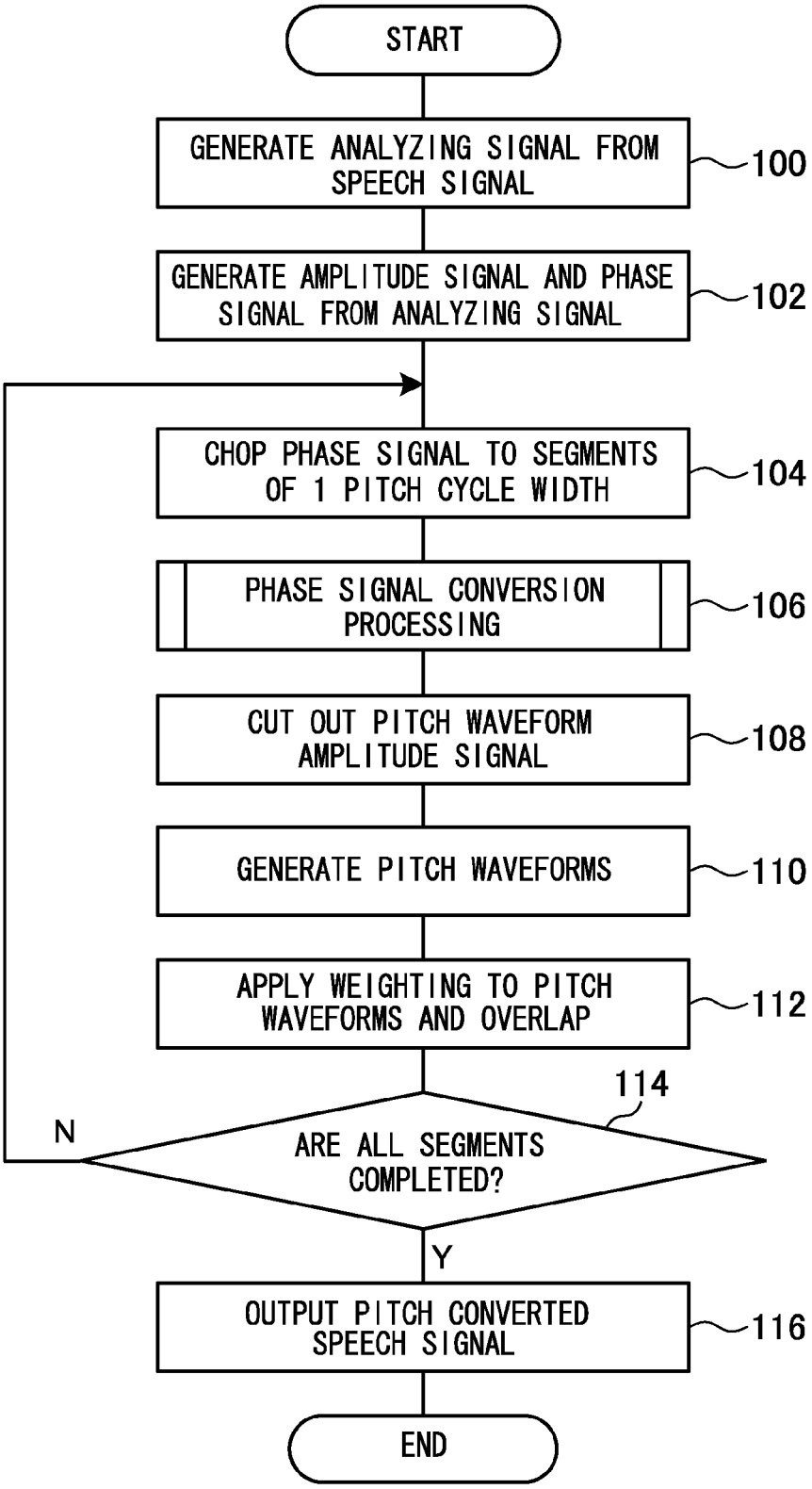
FIG. 10 is a flow chart illustrating speech signal processing in the first exemplary embodiment.

At step 100 of the speech signal processing illustrated in FIG. 10, the analyzing signal generation section 14 generates from the speech signal that is the input real signal, an analyzing signal that is a complex signal on the time axis as represented by Equation (1) by employing for example a Hilbert transform.

Next at step 102, the amplitude signal generation section 16 employs the real part signal I (t) and the imaginary part signal Q (t) configuring the analyzing signal generated at step 100 to generate an amplitude signal A(t) on the time axis of the speech signal according to Equation (2). The phase signal generation section 18 also employs the real part signal I (t) and the imaginary part signal Q (t) configuring the speech signal generated at step 100 to generate a phase signal θ(t) on the time axis of the speech signal according to Equation (3).

Next at step 104, the phase signal chopping section 20 references the pitch marks applied to the speech signal to chop segments of 1 pitch cycle T0 width sandwiched between pitch marks from the phase signal θ(t) generated at step 102 to give a chopped phase signal.

Figure 11:
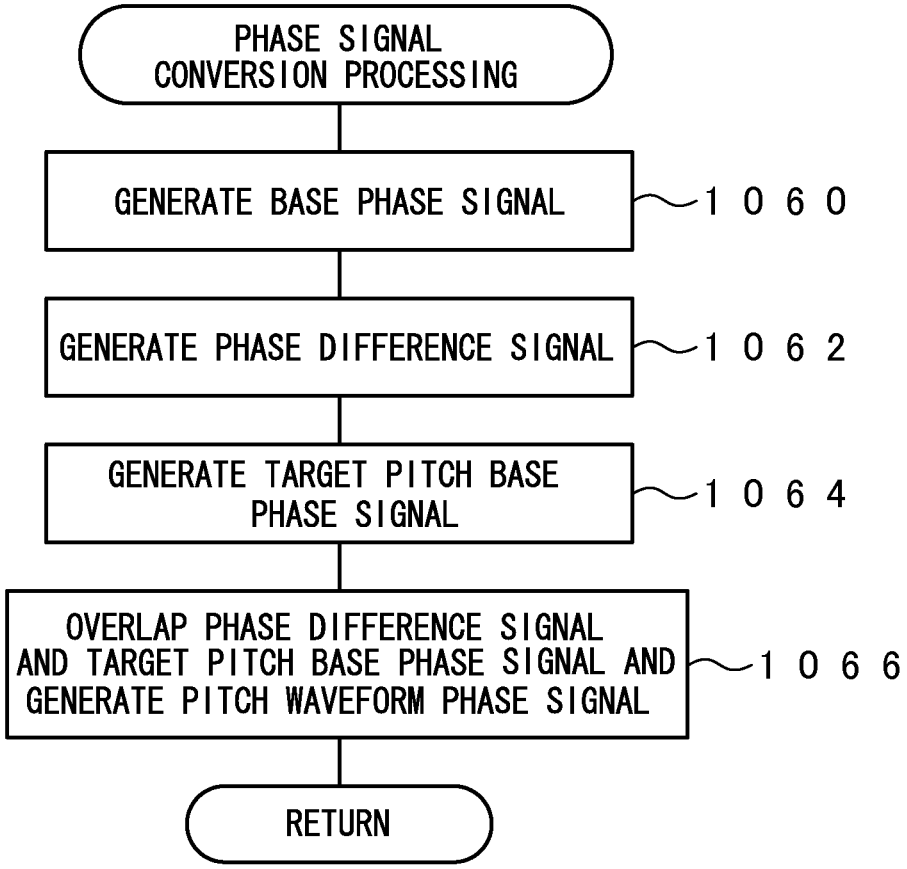
FIG. 11 is a flow chart illustrating phase signal transformation processing in the first exemplary embodiment.

Next at step 106, the phase signal conversion section 22 implements the phase signal conversion processing illustrated in FIG. 11.

At step 1060 of the phase signal conversion processing illustrated in FIG. 11, the base phase signal generation section 22*a* references the pitch marks applied to the speech signal and generates a base phase signal. The base phase signal is generated so as to monotonically increase from the start point towards the end point of the pitch cycle T0, with a phase difference of 2π between the end point and the start point.

Then at step 1062, the phase difference signal generation section 22*b* generates a phase difference signal in which the base phase signal generated in step 1060 is subtracted from the chopped speech signal of pitch cycle T0 width that was chopped at step 104 of the speech signal processing (FIG. 10).

Next, at step 1064, the target pitch base phase signal generation section 22*c* references the target pitch cycle T1 to generate the target pitch base phase signal. The target pitch base phase signal is generated so as to monotonically increase from the start point towards the end point of the target pitch cycle T1, with a phase difference of 2π between the end point and the start point. Target pitch base phase signals are also generated corresponding respectively to the section (section A) of the target pitch cycle T1 at the head portion of the phase difference signal generated at step 1062 and to the section (section B) of the target pitch cycle T1 at the tail portion of the phase difference signal.

Next, at step 1066, the target pitch phase signal generation section 22*d* overlaps the phase difference signal of section A generated at step 1062 with the target pitch base phase signal of section A generated at step 1064 to generate the pitch waveform phase signal $\phi_A(t)$. Moreover, in a similar manner, the target pitch phase signal generation section 22*d* overlaps the phase difference signal of section B generated at step 1062 with the target pitch base phase signal of section B generated at step 1064 to generate the pitch waveform phase signal $\phi_B(t)$. Processing then returns to the speech signal processing (FIG. 10).

At step 108 of the speech signal processing illustrated in FIG. 10, the amplitude signal cutting-out section 24 cuts out the pitch waveform amplitude signal $a_A(t)$ of the section A, and the pitch waveform amplitude signal $a_B(t)$ of the section B, from the amplitude signal A(t) generated at step 102.

Then at step 110, the pitch waveform generation section 26 generates the section A pitch waveform $P_A(t)$ from the pitch waveform amplitude signal $a_A(t)$ cut out at step 108 and the pitch waveform phase signal $\phi_A(t)$ generated at step 1066 of the phase signal conversion processing (FIG. 11). In a similar manner, the pitch waveform generation section 26 generates the section B pitch waveform $P_B(t)$ from the pitch waveform amplitude signal $a_B(t)$ cut out at step 108 and the pitch waveform phase signal $\phi_B(t)$ generated at step 1066 of the phase signal conversion processing (FIG. 11).

Then at step 112, the pitch waveform weighting and overlapping section 28 applies a weighting to each of the section A pitch waveform $P_A(t)$ and the section B pitch waveform $P_B(t)$ generated at step 110. The pitch waveforms of both weighted sections are then added together to generate the pitch converted speech signal of pitch cycle that is the target pitch cycle T1.

Next, at step 114, the phase signal chopping section 20 determines whether or not processing to convert pitch cycle has been completed for all segments of the input speech signal. Processing returns to step 104 when there are still un-processed segments present, and the processing of step 104 to step 112 is repeated for the next segment. Processing proceeds to step 116 when the processing for all the segments has been completed, and the pitch waveform weighting and overlapping section 28 outputs a pitch converted speech signal for all the segments generated at step 112 from a speaker 40, and the speech signal processing is then ended.

As explained above, according to the speech signal processing apparatus 10 of the first exemplary embodiment, the analyzing signal that is the complex signal on the time axis of the speech signal is generated from the speech signal, and a phase signal on the time axis generated from the analyzing signal is converted into a phase signal reflecting the characteristics of the target pitch cycle speech signal. This accordingly enables suppression of deterioration in speech signal quality due to a reduction in the amplitude and jumps in phase after pitch cycle conversion.

Figure 12:
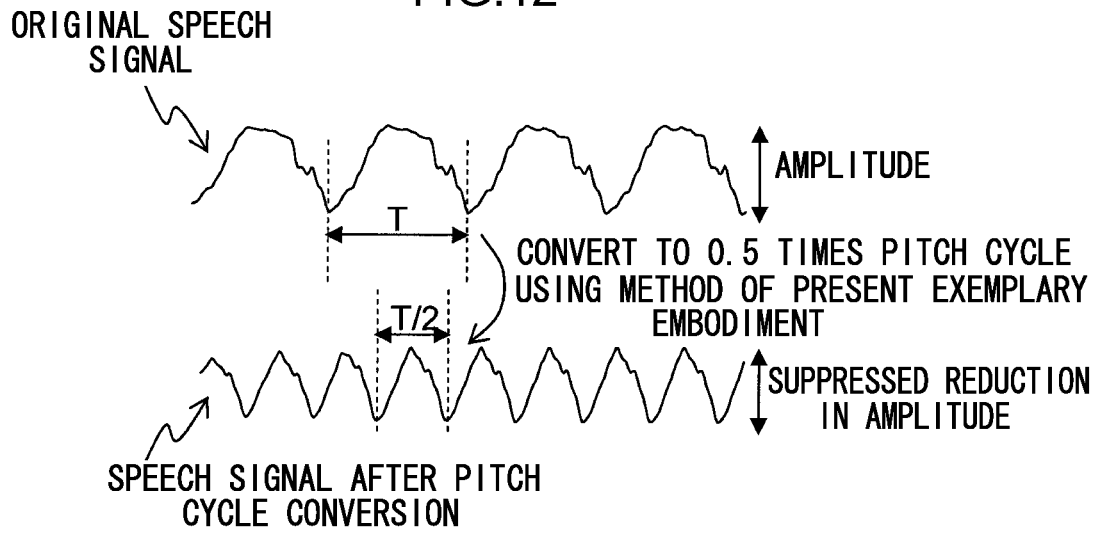
FIG. 12 is an illustration to explain an advantageous effect of the first exemplary embodiment.
Figure 13:
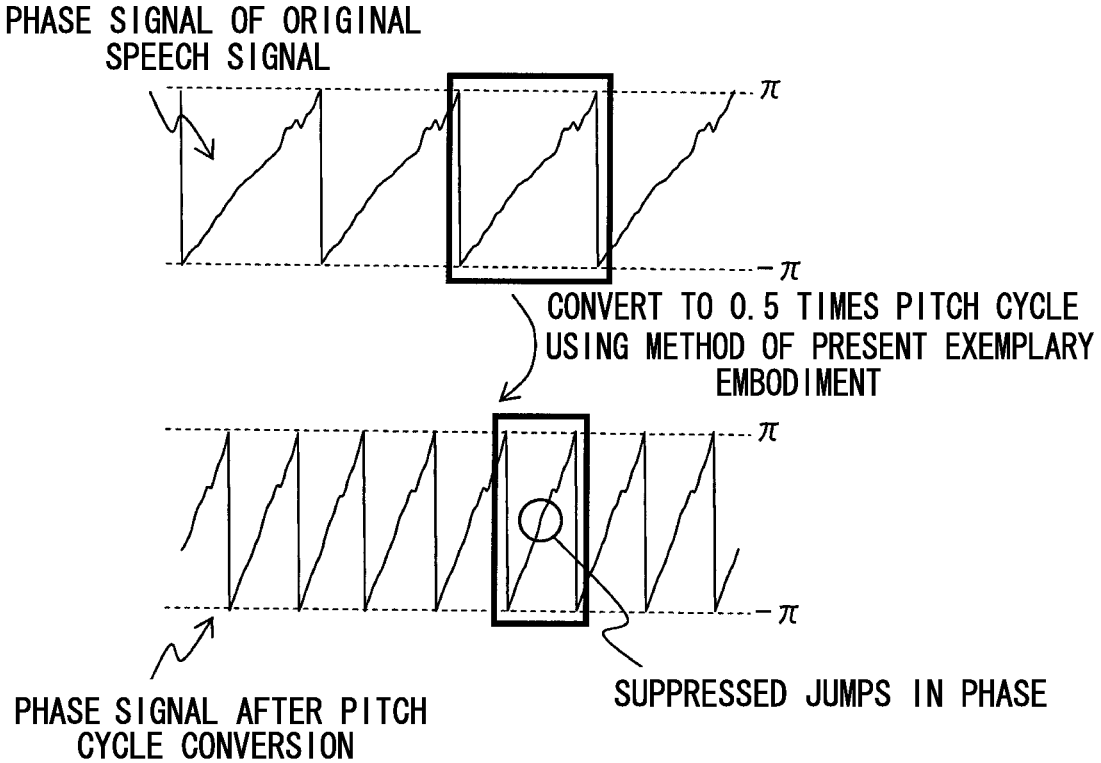
FIG. 13 is an illustration to explain an advantageous effect of the first exemplary embodiment.
Figure 17:
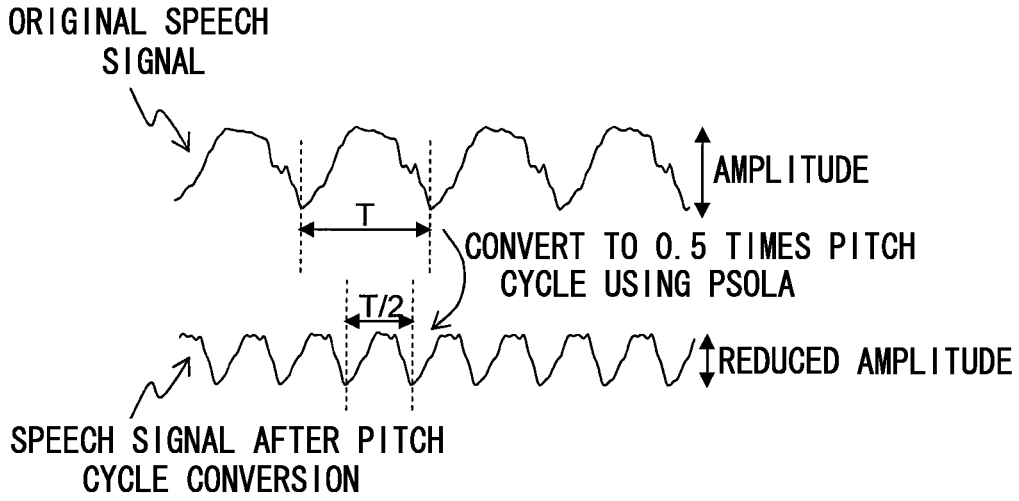
FIG.17 RELATED ART
FIG. 17 is an illustration to explain a drop in amplitude in a conventional method.
Figure 18:
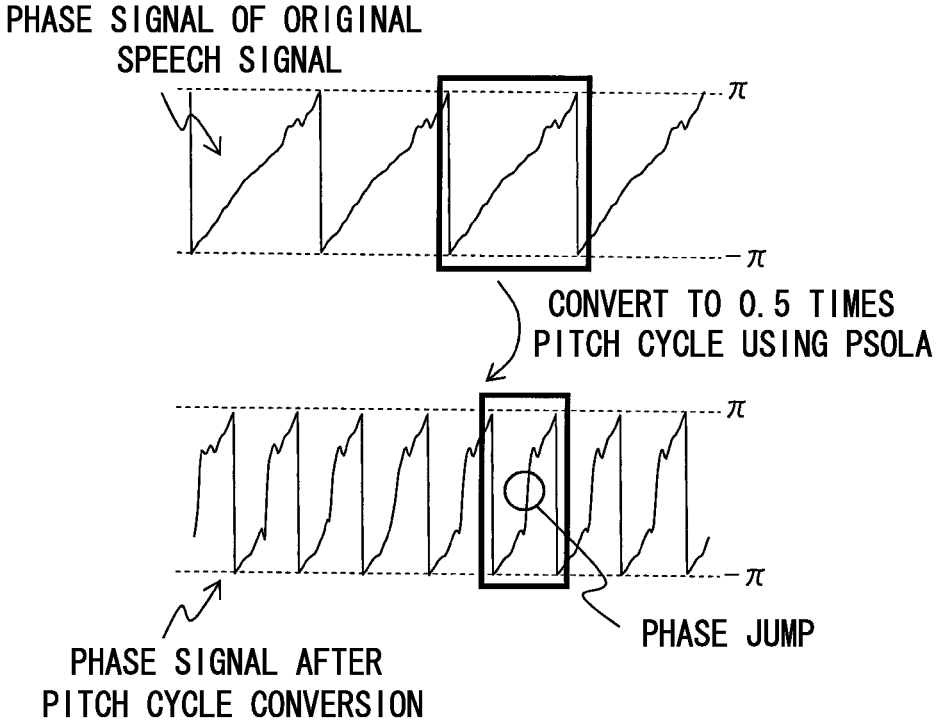
FIG.18 RELATED ART
FIG. 18 is an illustration to explain jumps in phase in a conventional method.

FIG. 12 illustrates an example of a speech signal in a case in which an original speech signal similar to that of FIG. 17 has been converted to 0.5 times the pitch cycle using the method of the present exemplary embodiment. Employing the method of the present exemplary embodiment enables suppression of a reduction in amplitude of the speech signal after pitch cycle conversion. Moreover, FIG. 13 illustrates an example of a phase signal in a case in which an original speech signal similar to that of FIG. 18 has been converted to 0.5 times the pitch cycle using the method of the present exemplary embodiment. Employing the method of the present exemplary embodiment enables jumps in phase after pitch cycle conversion to be suppressed.

Second Exemplary Embodiment

Explanation now follows regarding a second exemplary embodiment of technology disclosed herein. The configuration of a speech signal processing apparatus 210 according to the second exemplary embodiment is, except in the phase signal conversion section 222, similar to the configuration of the speech signal processing apparatus 10 according to the first exemplary embodiment. Explanation thus follows regarding the phase signal conversion section 222.

Figure 14:
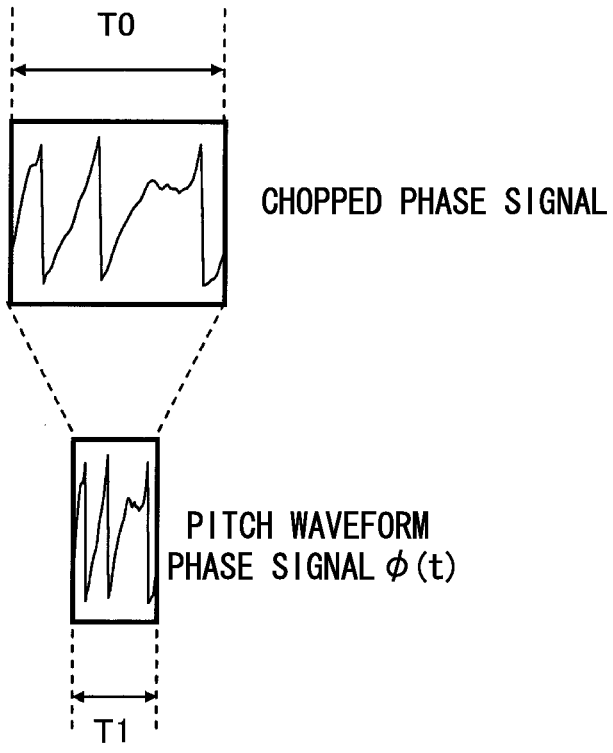
FIG. 14 is a schematic diagram to explain processing of a phase signal conversion section in a second exemplary embodiment.

The phase signal conversion section 222, as illustrated in FIG. 14, generates a pitch waveform phase signal $\phi(t)$ of the chopped phase signal chopped at pitch cycle T0 width chopped by the phase signal chopping section 20 and then expanded or contracted to the target pitch cycle T1 width. The expansion or contraction of the phase signal may for example be performed by linear interpolation processing.

Figure 15:
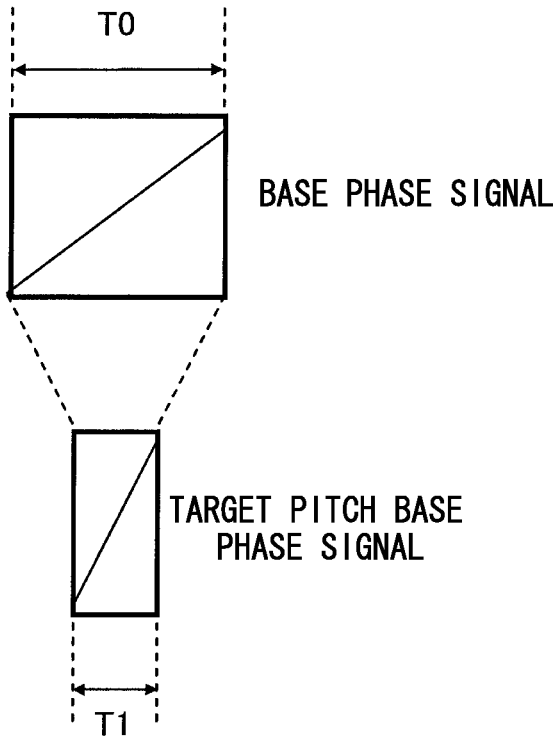
FIG. 15 is a schematic diagram to explain processing of a phase signal conversion section in the second exemplary embodiment.

The phase signal with pitch cycle width expanded or contracted from T0 to T1, as illustrated in FIG. 15, also has a base phase signal that is a component of the phase signal that has also been expanded or contracted in pitch cycle width from T0 to T1 to give the target pitch base phase signal. Consequently, similarly to in the first exemplary embodiment, the base phase signal that dominates the characteristics of a speech signal is appropriately converted to correspond to the target pitch cycle.

The speech signal processing apparatus 210, similarly to in the first exemplary embodiment, may for example be implemented by a computer 30 as illustrated in FIG. 3. Moreover, it is possible to implement the speech signal processing apparatus 210 with, for example, a semiconductor integrated circuit, and more particularly by an ASIC.

Explanation next follows regarding operation of only portions of the second exemplary embodiment that differ from those of the first exemplary embodiment. In the second exemplary embodiment, the speech signal processing apparatus 210 executes the phase signal conversion processing illustrated in FIG. 16 at step 106 of the speech signal processing illustrated in FIG. 10.

Figure 16:
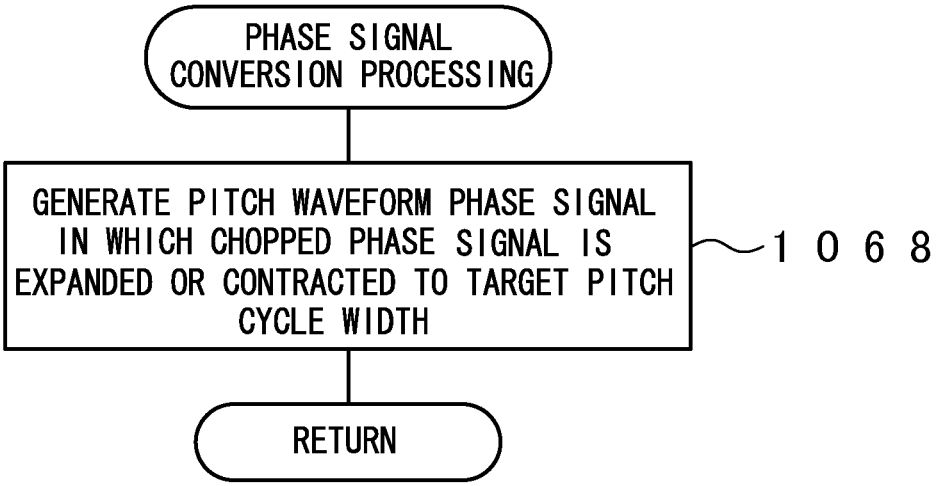
FIG. 16 is a flow chart illustrating phase signal transformation processing in the second exemplary embodiment.

At step 1068 of the phase signal conversion processing illustrated in FIG. 16, the phase signal conversion section 222 generates a pitch waveform phase signal $\phi(t)$ of the chopped phase signal of pitch cycle T0 width that was chopped at step 104 of the speech signal processing (FIG. 10) that has been expanded or contracted to a target pitch cycle T1 width. Then after the pitch waveform phase signal $\phi(t)$ has been generated processing returns to the speech signal processing (FIG. 10).

In the first exemplary embodiment, the pitch waveform phase signal $\phi_A(t)$ and the pitch waveform phase signal $\phi_B(t)$ were generated for each of the section A and the section B, however at step 1068 only a single pitch waveform phase signal $\phi(t)$ is generated.

Thus, at step 110 of the speech signal processing illustrated in FIG. 10, the pitch waveform phase signal $\phi(t)$ generated at step 1068 is employed as a common pitch waveform phase signal to the section A and the section B. Specifically, the pitch waveform generation section 26 generates a pitch waveform $P_A(t)$ from the pitch waveform amplitude signal $a_A(t)$ cut out at step 108 and the pitch waveform phase signal $\phi(t)$ generated at step 1068 of the phase signal conversion processing (FIG. 16). Similarly, the pitch waveform generation section 26 generates a pitch waveform $P_B(t)$ from the pitch waveform amplitude signal $a_B(t)$ cut out at step 108 and the pitch waveform phase signal $\phi(t)$ generated at step 1068 of the phase signal conversion processing (FIG. 16).

As explained above, according to the speech signal processing apparatus 210 of the second exemplary embodiment, similar advantageous effects to those of the first exemplary embodiment can be obtained by expanding or contracting the chopped phase signal of the pitch cycle T0 width to the target pitch cycle T1 width.

Note that in the first exemplary embodiment and the second exemplary embodiment, although explanation has been given of cases in which during cutting out the section A is cut out at the head portion and the section B is cut out at the tail portion of 1 pitch cycle, there is no limitation thereto, and appropriate sections may be cut out according to the target pitch cycle.

Moreover, in the first and second exemplary embodiments, explanation has been given of an example in which the pitch cycle is for example converted to being narrower by a factor of 0.5 times, however the pitch cycle conversion ratio is not limited to such a value. Moreover, there is no limitation to cases in which the pitch cycle is made narrower, and for example the technology disclosed herein may be applied in cases in which the pitch cycle is converted to be for example 1.5 times wider.

Moreover, as an example of the speech signal processing program of the technology disclosed herein a mode has been explained in which the speech signal processing program 50 is pre-stored (pre-installed) on the storage section 36. However, it is possible for the speech signal processing program of the technology disclosed herein to be provided stored on a recording medium such as a CD-ROM or a DVD-ROM.

The technology disclosed herein is applicable for example to applications for reading out text and for voice guidance systems. Moreover, it is possible to provide the technology disclosed herein through a network as a web service.

One aspect of the technology disclosed herein has the advantageous effect of enabling suppression of deterioration in audio quality due to reduction in amplitude and jumps in phase after pitch cycle conversion.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A speech signal processing apparatus comprising:

a processor configured to generate, based on an analyzing signal expressed by a complex signal generated from a speech signal to which pitch marks are applied per 1 pitch cycle, an amplitude signal and a phase signal on a time axis of the speech signal;

convert the generated phase signal into a phase signal of a target pitch cycle width per section of a 1 pitch cycle width based on the pitch marks; and generate a speech signal in which a pitch cycle is converted to the target pitch cycle based on an amplitude signal of the target pitch cycle width of a section corresponding to the section of the generated amplitude signal and the converted phase signal of the target pitch cycle width.

2. The speech signal processing apparatus of claim 1, wherein the processor is configured to convert the phase signal of a respective section to a phase signal of the target pitch cycle width while preserving characteristics from a start point to an end point of the section of at least a base phase signal corresponding to a fundamental frequency of the speech signal.

3. The speech signal processing apparatus of claim 2, wherein the processor is configured to generate a base phase signal of the 1 pitch cycle width;

generate a phase difference signal from a difference between a phase signal of a respective for ch section and the generated base phase signal;

generate a target pitch base phase signal of the target pitch cycle width; and overlap the phase difference signal of the target pitch cycle width in the generated phase difference signal with the generated target pitch base phase signal, to generate the phase signal of the target pitch cycle width.

4. The speech signal processing apparatus of claim 2, wherein the processor is configured to generate a phase signal of the target pitch cycle width in which a phase signal of the 1 pitch cycle width has been expanded or contracted to the target pitch cycle width.

5. A speech signal processing method, comprising:

generating, based on an analyzing signal expressed by a complex signal generated from a speech signal to which pitch marks are applied per 1 pitch cycle, an amplitude signal and a phase signal on a time axis of the speech signal;

converting the generated phase signal into a phase signal of a target pitch cycle width for a respective section of a 1 pitch cycle width based on the pitch marks; and generating, by a processor, a speech signal in which a pitch cycle is converted to the target pitch cycle based on an amplitude signal of the target pitch cycle width of a section corresponding to the section of the generated amplitude signal and the converted phase signal of the target pitch cycle width.

6. The speech signal processing method of claim 5, wherein, when converting the phase signal, the phase signal of a respective section is converted to a phase signal of the target pitch cycle width while preserving characteristics from a start point to an end point of the section of at least a base phase signal corresponding to a fundamental frequency of the speech signal.

7. The speech signal processing method of claim 6, wherein when converting the phase signal:

a base phase signal of the 1 pitch cycle width is generated;

a phase difference signal is generated from a difference between a phase signal for the respective section and the generated base phase signal;

a target pitch base phase signal of the target pitch cycle width is generated; and a phase difference signal of the target pitch cycle width in the generated phase difference signal is overlapped with the generated target pitch base phase signal to generate the phase signal of the target pitch cycle width.

8. The speech signal processing method of claim 6, wherein, when converting the phase signal, a phase signal of the target pitch cycle width is generated in which a phase signal of the 1 pitch cycle width has been expanded or contracted to the target pitch cycle width.

9. A non-transitory computer-readable recording medium having stored therein a speech signal processing program causing a computer to execute processing comprising:

generating, based on an analyzing signal expressed by a complex signal generated from a speech signal to which pitch marks are applied per 1 pitch cycle, an amplitude signal and a phase signal on a time axis of the speech signal;

converting the generated phase signal into a phase signal of a target pitch cycle width for a respective section of a 1 pitch cycle width based on the pitch marks; and generating a speech signal in which a pitch cycle is converted to the target pitch cycle based on an amplitude signal of the target pitch cycle width of a section corresponding to the section of the generated amplitude signal and based on athe converted phase signal of the target pitch cycle width.

10. The non-transitory computer-readable recording medium of claim 9, the speech signal processing program causing the computer to execute processing, wherein, when converting the phase signal, the phase signal of the respective section is converted to a phase signal of the target pitch cycle width while preserving characteristics from a start point to an end point of the section of at least a base phase signal corresponding to a fundamental frequency of the speech signal.

11. The non-transitory computer-readable recording medium of claim 10, the speech signal processing program causing the computer to execute processing, wherein when converting the phase signal:

a base phase signal of the 1 pitch cycle width is generated;

a phase difference signal is generated from a difference between a phase signal for the respective section and the generated base phase signal;

a target pitch base phase signal of the target pitch cycle width is generated; and a phase difference signal of the target pitch cycle width in the generated phase difference signal is overlapped with the generated target pitch base phase signal to generate the phase signal of the target pitch cycle width.

12. The non-transitory computer-readable recording medium of claim 10, the speech signal processing program causing the computer to execute processing, wherein, when converting the phase signal, a phase signal of the target pitch cycle width is generated in which a phase signal of the 1 pitch cycle width has been expanded or contracted to the target pitch cycle width.

* * * * *